US009677850B2

(12) United States Patent
Palmer

(10) Patent No.: US 9,677,850 B2
(45) **Date of Patent: *Jun. 13, 2017**

(54) RUBBER BAND MOUNTED RETICLE LEVELING DEVICE FOR USE IN LEVELING TELESCOPIC RIFLE SIGHT

(71) Applicant: Straight Shot LLC, San Francisco, CA (US)

(72) Inventor: James L. Palmer, San Francisco, CA (US)

(73) Assignee: Straight Shot LLC, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/267,959

(22) Filed: Sep. 16, 2016

(65) Prior Publication Data

US 2017/0045332 A1 Feb. 16, 2017

Related U.S. Application Data

(63) Continuation of application No. 14/774,306, filed as application No. PCT/US2014/023412 on Mar. 11, 2014, now Pat. No. 9,448,038.

(60) Provisional application No. 61/779,240, filed on Mar. 13, 2013.

(51) Int. Cl.

| | |
|---|---|
| ***F41G 1/54*** | (2006.01) |
| ***F41G 1/38*** | (2006.01) |
| ***F41G 1/44*** | (2006.01) |

(52) U.S. Cl.

CPC ..... *F41G 1/545* (2013.01); *F41G 1/38* (2013.01); *F41G 1/44* (2013.01)

(58) Field of Classification Search

CPC ... F41G 1/545; F41G 1/38; F41G 1/54; F41G 1/44; F41G 3/323; F41G 3/326; F41G 5/26

USPC ... 42/120, 90, 111, 113, 114, 115, 124, 125, 42/126, 134, 135, 121

See application file for complete search history.

(56) References Cited

U.S. PATENT DOCUMENTS

| | | | | |
|---|---|---|---|---|
| 3,908,282 A * | 9/1975 | Steffan | F41G 1/54 | 33/286 |
| 5,406,733 A * | 4/1995 | Tarlton | F41G 1/44 | 33/292 |
| 5,442,860 A * | 8/1995 | Palmer | F41G 1/545 | 33/286 |
| 5,499,455 A * | 3/1996 | Palmer | F41G 1/545 | 33/DIG. 21 |

(Continued)

*Primary Examiner* — John D Cooper
(74) *Attorney, Agent, or Firm* — Fish & Richardson P.C.

(57) ABSTRACT

A device for aligning a telescopic sight includes two opposing reference cards connected to each other within a common plane by a connecting bar and a level indicator on a surface of at least one card. The alignment device is attached to the front or rear scope base of a firearm, so that the front surfaces of two opposing reference cards appear on either side of the reticle. Once the alignment device is secured to the scope base of the firearm, the reticle may be aligned with the bore axis by rotating the telescopic sight until the horizontal cross hair is parallel with any corresponding pair of reference lines of the reference cards. The alignment device can also include an adapter that allows the alignment device to be mounted to a firearm by coupling to a corresponding slot of a mounting platform.

15 Claims, 17 Drawing Sheets

(56) References Cited

U.S. PATENT DOCUMENTS

| | | | | |
|---|---|---|---|---|
| 5,878,504 | A * | 3/1999 | Harms | F41G 1/545 33/286 |
| 6,813,855 | B2 * | 11/2004 | Pinkley | F41G 1/44 33/286 |
| 7,100,319 | B2 * | 9/2006 | Paige | F41G 1/54 33/286 |
| 8,561,341 | B1 * | 10/2013 | Dihlmann | F41G 1/545 42/120 |
| 9,115,957 | B1 * | 8/2015 | Winker | F41G 3/323 |
| 2007/0113460 | A1 * | 5/2007 | Potterfield | F41G 1/44 42/120 |
| 2016/0040960 | A1 * | 2/2016 | Palmer | F41G 1/38 42/120 |

* cited by examiner

RUBBER BAND MOUNTED RETICLE LEVELING DEVICE FOR USE IN LEVELING TELESCOPIC RIFLE SIGHT

TECHNICAL FIELD

This invention relates to an alignment device for aligning the reticle of a telescopic sight, and more particularly to a device for truing the crosshairs of the reticle with respect to the barrel axis of a firearm.

BACKGROUND

A typical telescopic sight for use with a firearm includes a reticle having centrally located cross hairs, for example a vertical centerline and a horizontal centerline. Commonly, telescopic sights include adjustment controls that enable the operator of the firearm to make several main adjustments to the telescopic sight relative to the firearm. Three of these adjustments are an elevation adjustment of the horizontal hairline (i.e., movement of the horizontal hairline up or down), a lateral adjustment of the vertical hairline (i.e., movement of the vertical hairline left or right), and a rotational adjustment of the entire telescopic sight about the central axis of the telescopic sight.

The elevation adjustment is used to compensate for the arched path a fired projectile (e.g., bullet) will inherently follow from the muzzle of the firearm to the target. Once the elevation of a sight is properly adjusted for a given range, the intersection of the cross-hairs of the reticle will indicate a theoretical point of impact of the bullet at that range, even though the line of fire to the target (e.g., the actual path of the bullet), will not align with the line of sight (i.e., the straight line extension of the central axis of the telescopic sight to the target).

The lateral adjustment is used primarily for initial sighting, and also to compensate for any expected drift (e.g., left or right drift) by the bullet from the line of fire caused by cross winds between the firearm and the target.

The process of making elevation and windage adjustments to the sight of a firearm is called "sighting in." These adjustments typically will not remain consistent between sessions (or in some circumstances, even between successive shots), and are often difficult to adjust accurately prior to test-firing the firearm.

Apart from collimating the sight with the firearm, the mounted telescopic sight is rotatable about its central axis to adjust the relative position of the cross hairs of the sight with respect to the longitudinal and vertical axis of the barrel of the firearm (i.e., the bore axis). The adjustment is made to ensure that the vertical cross hair of the sight coincides with the vertical axis of the firearm. This adjustment can be made using a padded vice or cradle, a machinist's level, and a known vertical reference line. However, in the field, this adjustment has been proven to be quite difficult to execute accurately due to the lack of a known vertical reference line with respect to the bore axis of the barrel of the firearm.

One common method used to attempt to align the vertical cross hair of the sight with respect to the bore axis of the firearm includes holding the firearm perfectly level with respect to the ground and then "sighting in" on a reference line, such as the edge of a building which is known vertical with respect to the ground. With this method, the telescopic sight is simply rotated until the reference line and the vertical cross hair align. Unfortunately, however, this method is rarely successful because without the previously mentioned machinist's level and padded vise, there is no indication of when the firearm is being held truly level with respect to the ground. Since it is common to hold a firearm, such as a rifle, at a slight tilt or cant, any adjustment to the reticle will reflect the angle of the cant and will invariably fail to be truly aligned with the bore axis of the barrel of the firearm.

The problem with aligning the vertical hairline with respect to the bore axis of the firearm is that there is no fixed reference line against which such an adjustment may be accurately and easily made. Conventional mounts for mounting a sight to a firearm do not restrict or otherwise provide "self-alignment" of the mounted sight with respect to the bore axis of the firearm. Any reference line located on the sight will not remain (or may never be) consistently aligned with respect to the bore axis of the firearm, and therefore may not be used to properly adjust the hairlines of the reticle with respect to the bore axis of the firearm.

What is needed is an easy-to-use reticle alignment device for quickly aligning the cross-hairs of the reticle of a firearm-mounted telescopic sight with respect to the bore axis of the firearm. The device should include one or more apparatuses for quickly and accurately mounting the device on the firearm.

SUMMARY

In general, an alignment device uses the telescopic mounting elements of a rifle (e.g., the machined scope bases on the barrel) to provide an accessible reference line for aligning the cross hairs of a reticle of the scope-sight with respect to the bore axis of the barrel. Implementations of this device are easily mounted to most telescopic sight mount bases on any type of firearm including pistols, rifles and shotguns.

Implementations of this device may be used to quickly align the cross-hairs of the reticle of a firearm-mounted telescopic sight with respect to the bore axis of the firearm. In example implementations, a device has easily viewable reference lines for aligning the cross-hairs of the reticle of a firearm-mounted telescopic sight with respect to the bore axis of the firearm, and is easily attachable to the telescopic mounting boss of most types of firearms. The device also provides information regarding the alignment of the mounting boss of the firearm, such to judge the accuracy of the alignment, and additionally provides sufficient alignment guidance for a broad range of differently sized firearms. The device also provides information regarding the levelness of the firearm as it is being aimed, increasing the accuracy and predictability of the resulting shot.

In an example implementation, a device for aligning the cross-hairs of a reticle of a telescopic sight mounted on a mounting surface of a firearm includes a first card having at least one reference line arrayed across a front surface and at least one reference line arrayed across a rear surface, a second card having at least one reference line arrayed across a front surface and at least one reference line arrayed across a rear surface, and a connecting element holding the first card and the second card together in a common plane. The connecting element has at least one flat surface parallel to the reference lines of the reference cards. The device also includes a level mounted to an aperture in the first card and oriented in a direction parallel to the flat surface. When the device is positioned flush against the mounting surface of the firearm, the level indicates the levelness of the mounting surface, and the reference lines indicate the position of a properly aligned reticle.

Implementations of this aspect may include one or more of the following features:

In some implementations, the device also can include a first hook on the first card and a second hook on the second card. When the device is positioned flush against the mounting surface of the firearm, the device may be secured to the firearm by a fastener connecting the first hook to the second hook.

In some implementations, the thickness of the at least one line arrayed across the front surfaces of the cards can be different than the thickness of the one or more lines arrayed across the rear surfaces of the cards.

In some implementations, more than one line can be arrayed across the front surface of the cards and the more than one lines are parallel to one another.

In some implementations, the number of parallel lines of the front surfaces of the cards can be different than the number of parallel lines of the rear surfaces of the cards.

In some implementations, the device can include a grid on the front surfaces of the first and second cards.

In some implementations, the device can include a second level mounted to a second aperture in either the first card or the second card, where the second level is oriented in a direction then the direction of the first level.

In some implementations, the level can be visible from both sides of the first card.

In some implementations, the level can include a spirit level.

In some implementations, the fastener can be a rubber band.

In another example implementation, a device for aiding the cross-hair alignment of a reticle of a telescopic sight mounted on a mounting surface of a firearm includes a first card having a plurality of spaced apart parallel reference lines on a front surface of the first card and a plurality of spaced apart parallel reference lines on a rear surface of the first card. The device also includes a second card having a plurality of spaced apart parallel reference lines on a front surface of the second card and a plurality of spaced apart parallel reference lines on a rear surface of the second card, where the lines on the front surfaces of the first and second cards being of a different line thickness than the lines on the back surfaces of the first and second cards. The device also includes a connecting element holding the first card and the second card together in a common vertical plane, the connecting element having at least one flat surface parallel to the reference lines of the reference cards. The device also includes a spirit level mounted to an aperture in the first card and oriented in a direction parallel to the flat surface and visible from both sides of the first and second cards.

Implementations of this aspect may include one or more of the following features:

In some implementations, the device can include a mounting adapter. The mounting adapter can include at least one prong configured to mount in a slot on the mounting surface of the firearm.

In some implementations, when the device is positioned flush within the slot of the mounting surface of the firearm, the reference lines can indicate the position of the properly aligned reticle.

In some implementations, the mounting adapter can be disposed on the connecting element.

In some implementations, the mounting adapter can define a channel between two opposing surfaces of the mounting adapter, where a cross-section of the channel corresponds with a cross-section of the connecting element.

In some implementations, the mounting adapter can include at least one protrusion disposed above the channel.

In some implementations, the mounting adapter can be disposed between the first card and the second card.

In some implementations, the mounting adapter includes two prongs or three prongs.

In some implementations, the mounting adapter can be reversibly detachable from the device.

In another example implementation, a method of aligning the cross hairs of a reticle of a telescopic sight mounted on a firearm includes attaching to the telescopic sight a first card having at least one reference line arrayed across a front surface and at least one reference line arrayed across a rear surface, a second card having at least one reference line arrayed across a front surface and at least one reference line arrayed across a rear surface, a connecting element holding the first card and the second card together in a common plane, and a level mounted to an aperture in the first card and oriented in a direction parallel to the flat surface. The connecting element has at least one flat surface parallel to the reference lines of the reference cards. The method also includes positioning the device against the mounting surface of the firearm such that the connecting element is flat on a mounting surface on the gun and the level indicator indicates the gun is in a level position, and adjusting the horizontal cross hair of the reticle to be parallel to the reference lines on the first and second cards.

DETAILED DESCRIPTION

Figure 1:
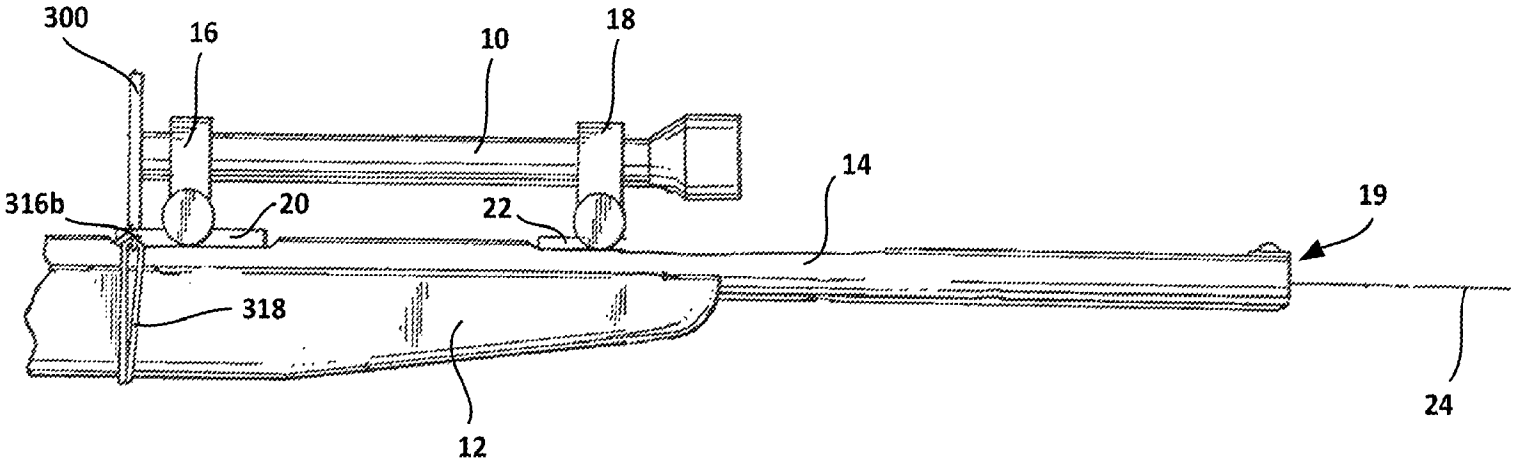
FIG. 1 is a partial side view of a firearm and showing the mounted position of an example alignment device.

Referring to FIG. 1, a telescopic sight 10 is mounted to a rifle 12. The scope-sight 10 is secured to the barrel 14 of the rifle 12 by a rear mount 16 and a front mount 18. The front mount 18 is closest to the muzzle 19 of the barrel 14. The rifle 12 includes a rear scope base 20 and a front scope base 22. The scope bases 20 and 22 are machined into or are otherwise attached to the top portion of the barrel 14, and are aligned with a bore axis 24 of the barrel 14. The rear and front scope bases 20 and 22 are adapted to receive their respective rear and front mounts 16 and 18.

Implementations of the disclosed device can use the machined scope bases 20 and 22 on the barrel 14 to provide an accessible reference line for aligning the cross hairs 28 and 30 of a reticle 26 of the telescopic sight 10 with respect to the bore axis 24 of the barrel 14. While a rifle 12 is shown as an example, this is a non-limiting example. Implementations of the reticle leveling device can be employed in conjunction with scope bases on other types of firearms, including pistols, rifles and shotguns.

Figure 2:
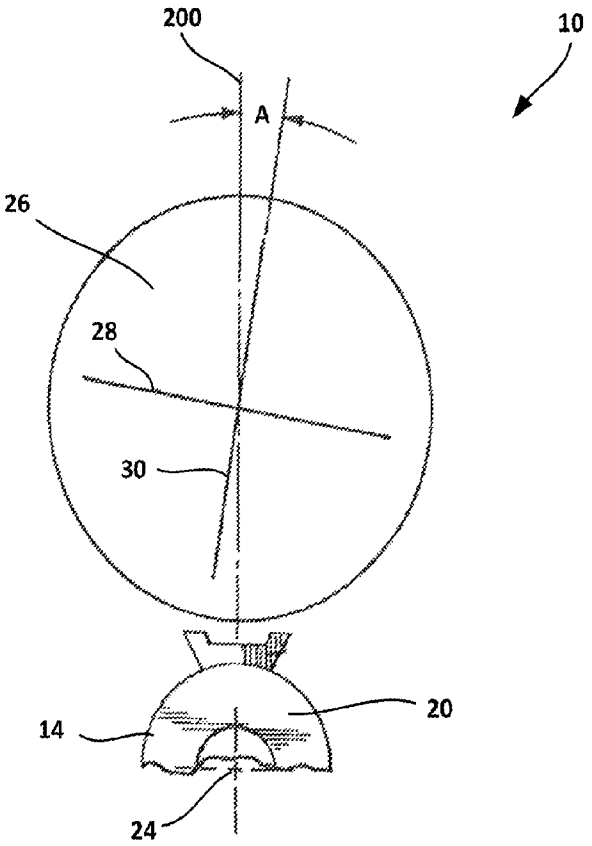
FIG. 2 is a front view of the cross-hairs of a misaligned reticle of a telescopic sight as viewed through the sight.

FIG. 2 illustrates an example of canted cross-hairs 28 and 30 of a reticle 26 of a telescopic scope 10. The cross hairs are canted or tilted from an accepted "true vertical" reference line 200 by an angle "A." The cross-hairs include a horizontal cross hair 28 and a vertical cross hair 30. The front scope base 20 is shown as a reference of "true vertical" with respect to the bore axis 24 of the barrel 14.

Figure 3A:
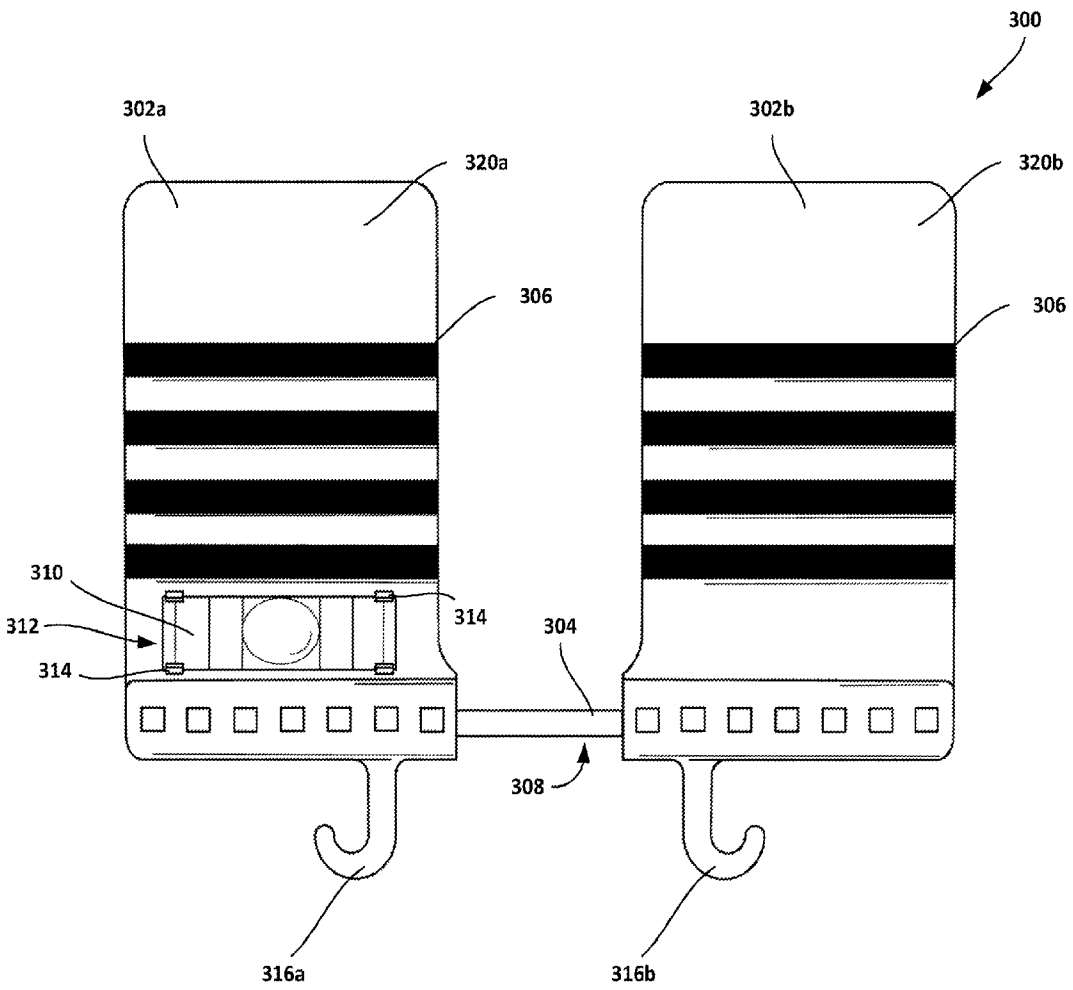
FIG. 3A is a front view of an example alignment device.
Figure 3C:
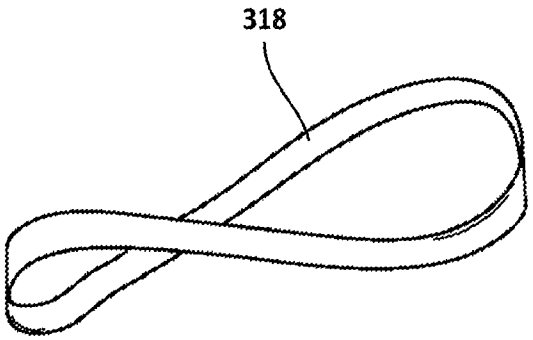
FIG. 3C shows an example rubber band.
Figure 3B:
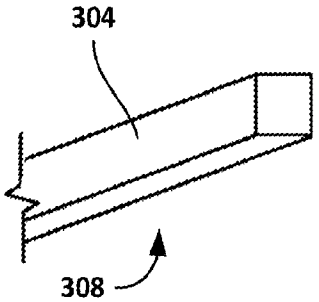
FIG. 3B shows a cross-section of an example connecting bar.
Figure 4:
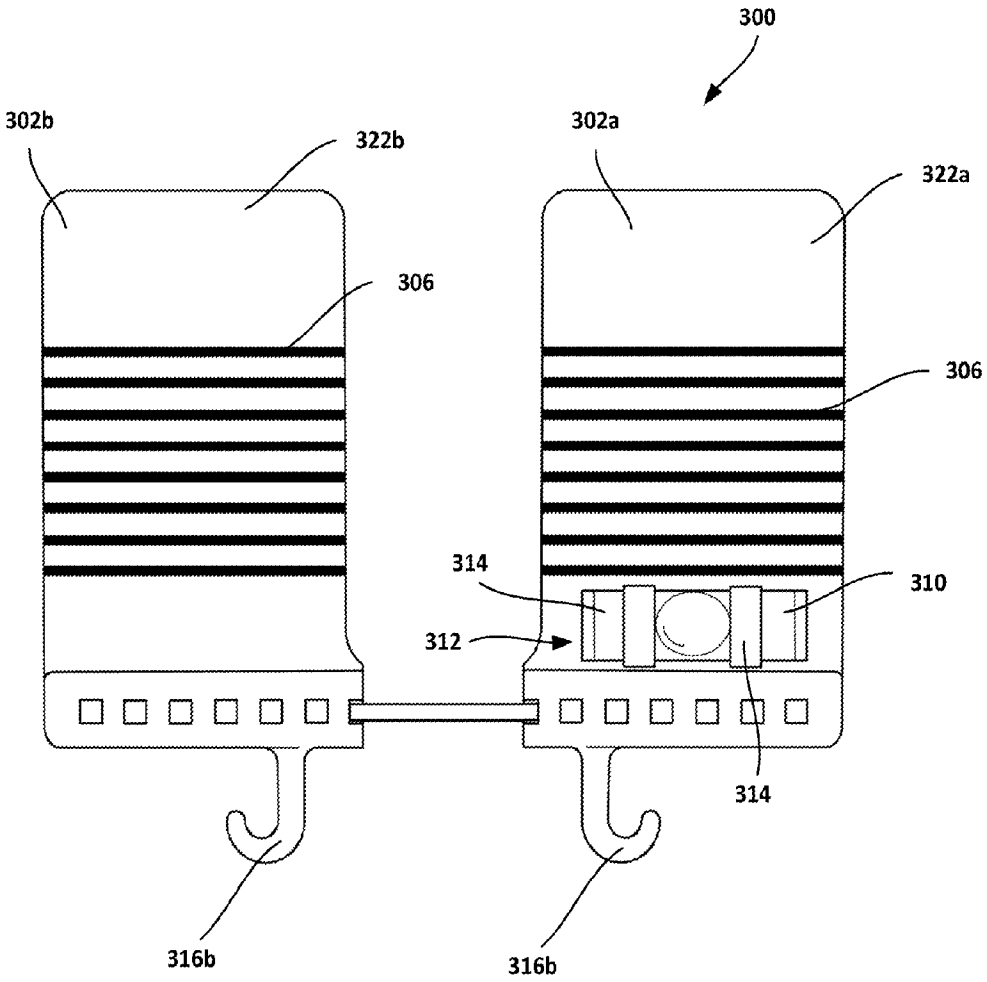
FIG. 4 is a rear view of an example alignment device.
Figure 5:
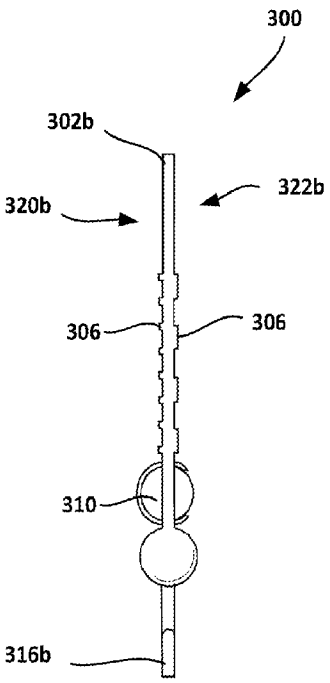
FIG. 5 is a side view of an example alignment device.

FIGS. 3A, 4, and 5 show the front, rear, and side of an example implementation of an alignment device 300, respectively. In this example, the alignment device 300 includes two opposing reference cards 302*a* and 302*b* connected to each other within a common plane by a connecting bar 304. As shown in FIGS. 3A and 3B, the connecting bar 304 is made from a bar stock having a square or rectangular cross section, which provides a flat lower surface 308. Alignment device 300 also includes a rubber band 318, as shown in FIG. 3C. Rubber band 318 is detachable from the other components of alignment device 300, and is made of an elastic material (e.g., rubber, latex, or other elastic material).

The reference cards 302*a* and 302*b* also include parallel reference lines 306 extending along front surfaces 320*a* and 320*b* and rear surfaces 322*a* and 322*b*. These references lines 306 are parallel to the connecting bar 304, and may be colored in order to provide contrast against references cards 302*a* and 320*b*. As an example, in some implementations, reference lines 306 arc darkly colored (e.g., black), while reference cards 302*a* and 302*b* are lightly colored (e.g., white). In another example, in some implementations, reference lines 306 is brightly colored (e.g., a bright green) while reference cards 302*a* and 302*b* are darkly color (e.g., black). Other combinations of contrasting colors may also be used, depending on the implementation. In some implementations, reference lines 306 may also be raised or recessed from reference cards 302*a* and 302*b* in order to provide additional contrast. For example, as shown in FIG. 5, reference lines 306 are raised from the front and rear surfaces 320*b* and 322*b* of reference card 302*b*. For some military, law enforcement, or tactical uses, non-glare black reference cards 302*a* and 302*b* bearing raised reference lines 306, which can be colored green, are preferred.

A level indicator 310 (e.g., a spirit level with a suspended bubble, or other similar leveling apparatus) is retained within an aperture 312 on a surface of reference card 302*a* by retaining tabs 314. Retaining tabs 314 secure the outer portions of level indicator 310 to reference card 302*a*, such that the major portion of level indicator 310 is visible to the user. Level indicator 310 is retained in an orientation parallel to connecting bar 304 and reference lines 306, and is mounted to be viewable from either the front surface 320*a* (as shown in FIG. 3) or the rear surface 322*a* (as shown in FIG. 4) of the reference card. In some embodiments, level indicator 310 is releasably or adjustably secured, and may be removed, adjusted, or replaced by the user as desired.

Hooks 316*a* and 316*b* are connected to a lower portion of each reference card 302*a* and 302*b*, respectively, and are provided to receive each respective end of the rubber band 318. The rubber band 318 is used to releasably secure the reticle leveling device to the rifle 12, as described below.

Figure 6:
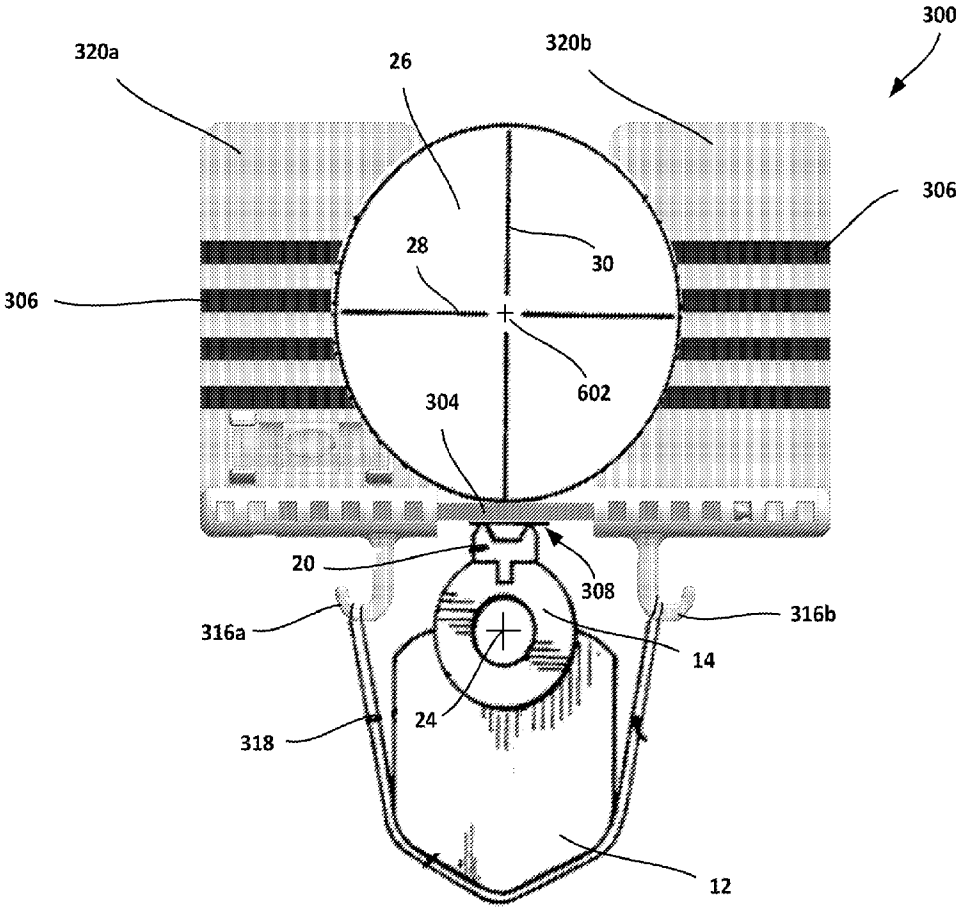
FIG. 6 is a front view of a firearm showing the mounted position of an example alignment device and of the cross hairs of the reticle of a telescopic sight as viewed through the sight.

In an example implementation, the alignment device 300 is attached to the front or rear scope base 20, as shown in FIGS. 1 and 6, so that the front surfaces 320*a* and 320*b* of two opposing reference cards 302*a* and 302*b* appear on either side of the reticle 26. The position of alignment device 300 can vary relative to telescopic sight 10. For example, in some implementations, the alignment device 300 can be positioned between the two ends of the telescopic sight 10. In another example, the alignment device 300 can be positioned behind of the viewing side of telescopic sight 300, such that the alignment device 300 is between a user and the telescopic sight 300 when the gun is pointed away from the user.

To secure the alignment device 300 to the rifle 12, the connecting bar 304 is positioned on one of the scope bases 20 or 22 and held in place by the rubber band 318, which is looped from a first hook 316*a* or 316*b*, around the barrel 14 (and stock section) of the rifle 12 to the other hook 316*a* or 316*b*. The elastic contracting force generated by the rubber band 318 looped around the rifle 12 draws the flat surface 308 of the connecting bar 304 into flush contact with the flat surface of the scope base 20 or 22. Since the scope base 20 or 22 is "true" with the bore axis 24, then the mounted connecting bar 304 and the reference lines 306 will likewise be "true" with the bore axis 24. The flat surface 308 of the connecting bar 304 maintains the alignment device 300 in an upright position relative to the rifle 12.

Once the alignment device 300 is secured to the scope base 20 or 22 of the rifle 12, as shown in FIG. 6, the reticle 26 may be aligned with the bore axis 24 by rotating the telescopic sight 10 until the horizontal cross hair 28 is parallel with any corresponding pair of reference lines 306. This is easily accomplished while sighting through the telescopic sight 10 and simultaneously comparing the horizontal cross hair 28 of the reticle 26 with the exposed reference lines 306 displayed on either side of the eyepiece of the telescopic sight 10.

Depending on the firearm and the telescopic sight used, the distance between the bore axis 24 of the firearm and the bore axis of the telescopic sight may vary. For example, in some implementations, the distance between the bore axis of the firearm and the bore axis of the telescopic sight can vary between approximately 1.5 and 2 inches, or more. To account for this variation, alignment device 300 can include several parallel reference lines 306 so that at least one pair of reference lines will lie relatively close to the horizontal cross hairs 28 of the reticle 26 during use.

In addition, alignment device 300 can also be reversed and reattached to the firearm, such that the rear surfaces 322*a* and 322*b* of the two opposing reference cards 302*a* and 302*b* appear on either side of the reticle 26. As illustrated in FIGS. 3 and 4, the rear surfaces 322*a* and 322*b* of reference cards 302*a* and 322*b* include reference lines 306 of a differing pattern that of front surfaces 320*a* and 320*b*. In some implementations, reference lines 306 of the front surfaces 320*a* and 320*b* may have a different width than those of the rear surfaces 322*a* and 322*b*. In some implementations, reference lines 306 of the front surfaces 320*a* and 320*b* may be spaced closer together or further from each other than those of the rear surfaces 322*a* and 322*b*. In some implementations, reference lines 306 of the front surfaces 320*a* and 320*b* may be differently colored than those of the rear surfaces 322*a* and 322*b*. Further, reference lines 306 need not be limited merely to a set of parallel lines. For example, in some implementations, reference lines 306 of the front surfaces or rear surfaces can instead be a different pattern, such as a grid. In this manner, device 300 may be flipped to provide the user with a variety of reference markings 306, allowing the user to select a set of reference markings 306 that best suits the dimensions of the firearm, the dimensions of the telescopic sight, the position of the telescopic sight when mounted to the firearm, and the type of adjustment being made.

Figure 7:
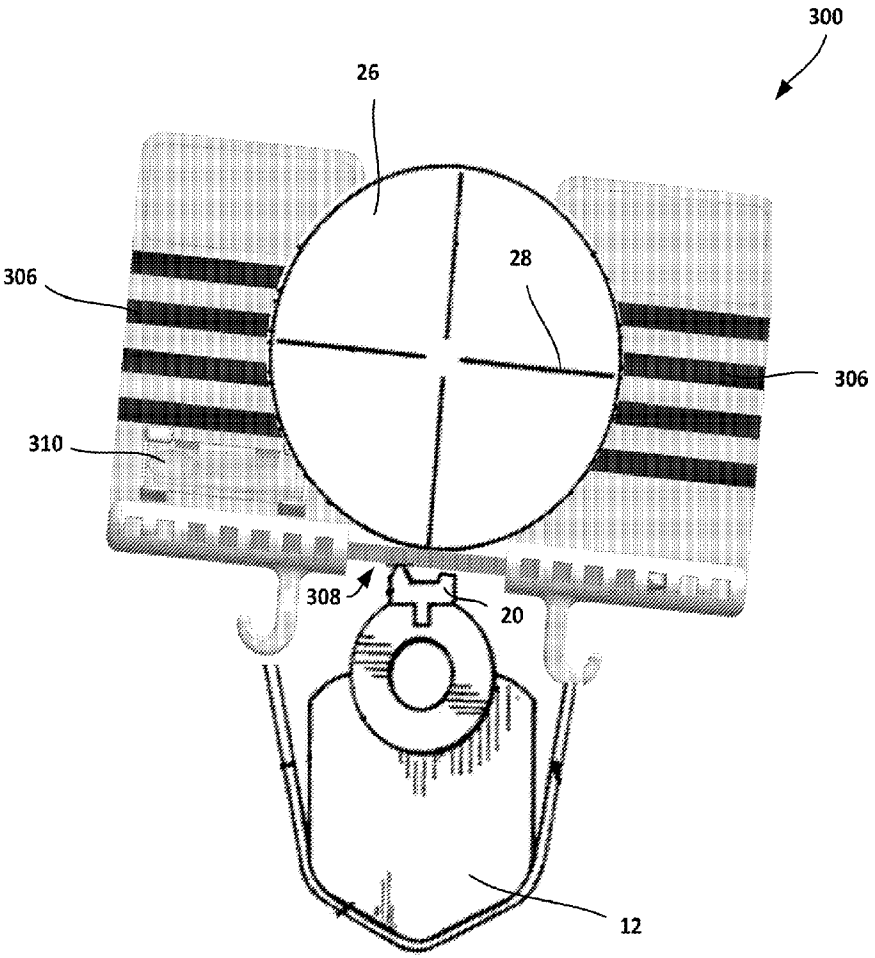
FIG. 7 is a front view of a firearm showing the mounted position of an example alignment device with a damaged mounting scope base, and of cross-hairs of a reticle of a telescopic sight as viewed through the sight.

During the use, transport, or servicing of a rifle, various components of the rifle might be misaligned or damaged in ways that affect the proper alignment of telescopic sight 10. For instance, a rifle that is improperly disassembled and reassembled, subjected to wear, or otherwise abused may have a scope base 20 or 22 that is no longer level with respect to the barrel and is no longer "true" with the bore axis 24. A telescopic sight 10 mounted on such a base would be misaligned, potentially affecting its accuracy. Alignment device 300 can be used to check the levelness of these and other mounting surfaces. As shown in FIG. 7, in an example implementation, a rifle 12 with a damaged scope base 20 is mounted in an orientation known to be level, such as on a machinist's level. Device 300 is then attached to rifle 12, as described above, such that flat surface 308 abuts scope base 20. Level element 310 provides information regarding the levelness of the surface upon which device 300 it is mounted. For instance, damage of scope base 20 is shown in FIG. 7, which results in a misalignment of telescopic sight 10 and a clockwise rotation of device 300. While the cross-hair 28 of reticle 26 remains parallel to reference lines 306, improper rotation of telescopic sight 10 is indicated by level element 310. In some implementations, one or more additional level elements, each of a different orientation than the first, can be included on device 300. For example, multiple level indicators 310 can be mounted in the plane of reference cards 302*a* and 302*b*, one horizontally, one vertically, and one diagonally. In another example, one or more level indicators 310 can be mounted orthogonal to the plane of reference cards 302*a* and 302*b*. In this manner, the relative displacement from a level condition of device 300, when mounted to a rifle 12, may be evaluated with respect to more than one orientation to provide information regarding the alignment or condition of various components of rifle 12.

As level indicator 310 is mounted within aperture 312, level indicator 310 remains visible to the user regardless of which side the user selects. This allows a user to make adjustments from either side of the card based on information from a single level indicator 310. In addition to reducing the cost of manufacturing device 300, this arrangement also increases the reproducibility of the measurements made by device 300. In referring to a single level indicator 310, regardless of the viewing surface, a user can adjust the reticle in a consistent manner without fear of possible side-dependent variations between two different levels. In implementations of device 300 with multiple level indicators 310, each level indicator 310 can be mounted in similar apertures 312 such that they can also be viewed from each side of the device. In this manner, the user can refer to a single set of level indicators 310 regardless of what side of the device is facing the user. In another implementation, a second level indicator is vertically mounted on the surface of reference card 302*a* immediately above, and at a right angle, to level indicator 310. Thus the alignment can be carried using horizontal and vertical leveling indicators.

If telescopic sight 10 is known to be true with bore axis 24, for instance after adjustment using device 300, level indicator 310 can additionally provide information regarding the levelness of rifle 12 with respect to the ground. This can be advantageous when a user wishes to avoid canting the rifle during the firing of a projectile, as this cant might significantly alter the expected trajectory of the projectile. In an example implementation, the user mounts device 300 to rifle 12, ensures that reference lines 306 are aligned with the crosshairs 28 and 30 of reticle 26, then refers to level indicator 310 prior to firing rifle 12. As level indicator 310 is parallel to both reference lines 306 and surface 308, the user may refer to level indicator 310 to accurately judge the canting of the rifle, ensuring a level and uncanted shot. This eliminates the need for a distant horizontal or vertical reference point (which is often not present, or not truly horizontal or vertical), and allows the user to make a level shot under a wide variety of environment conditions.

Figure 9:
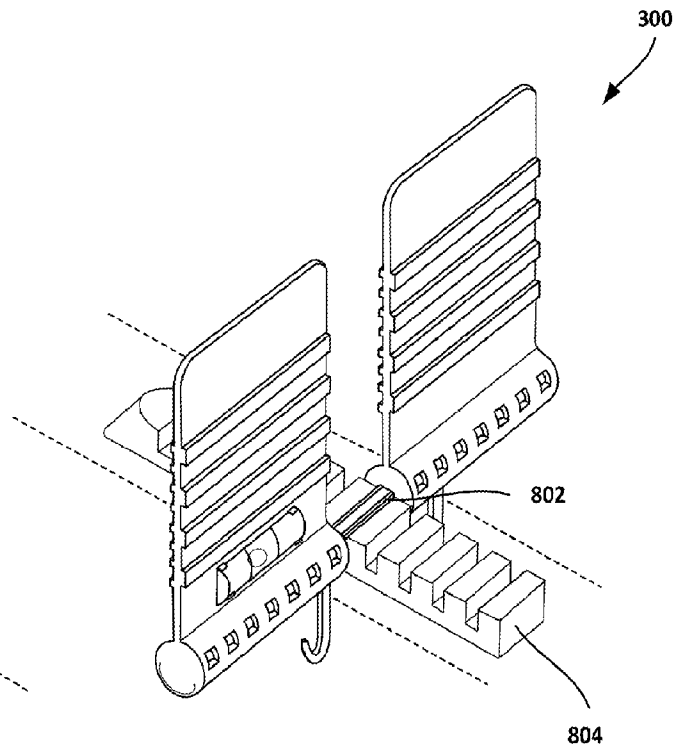
FIGS. 8 and 9 illustrate insertion of one embodiment of an alignment device into a slotted mounting platform.
Figure 8:
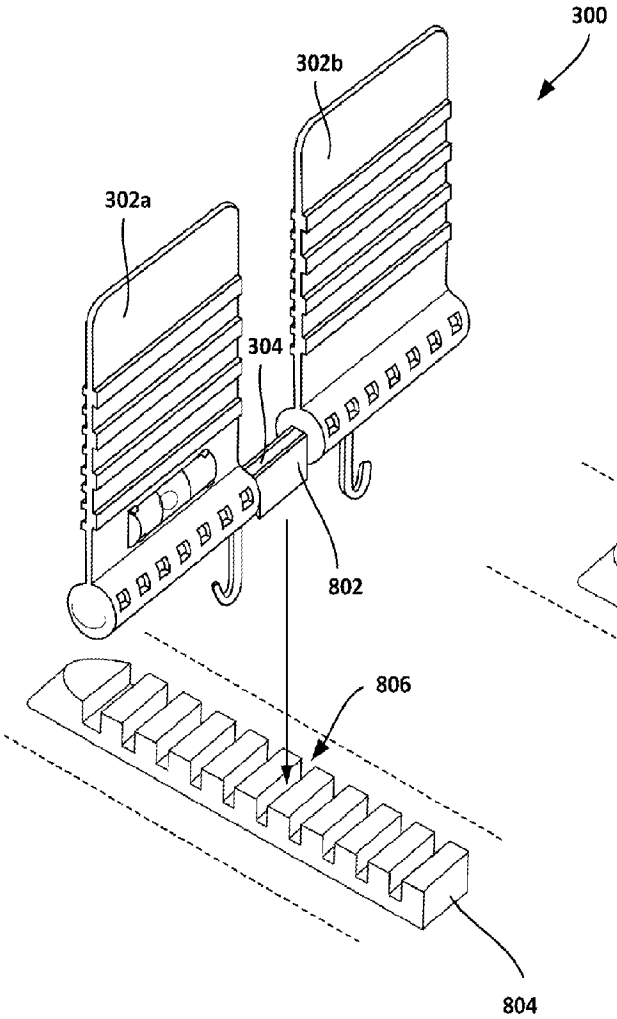
Figure 10:
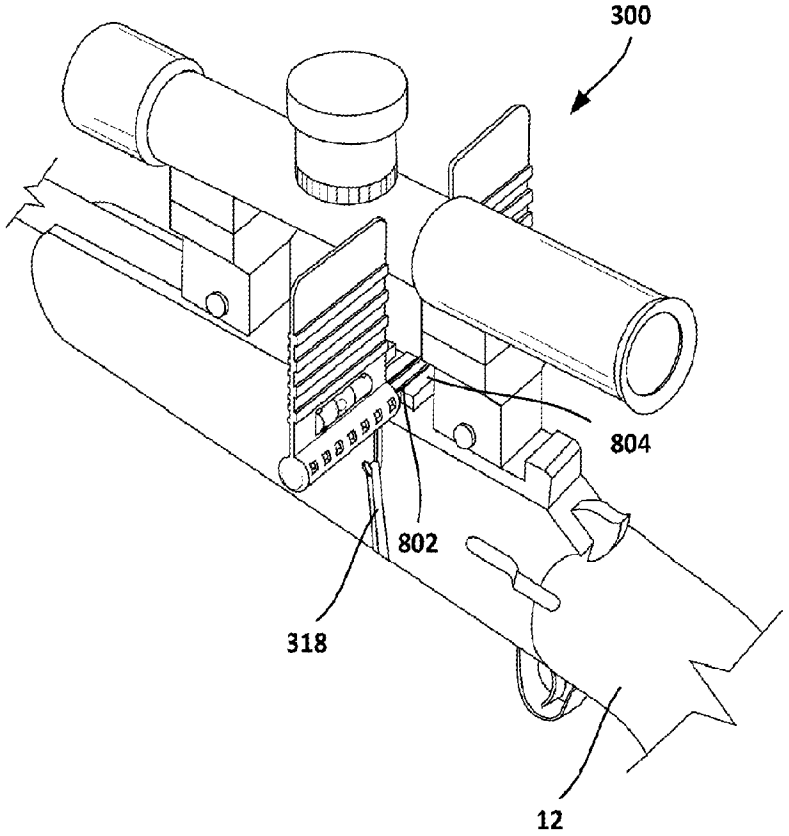
FIG. 10 shows one embodiment of an alignment device mounted to a firearm having a slotted mounted platform.

In the above examples, an alignment device 300 is mounted to a rifle 12 by positioning the flat lower surface 308 of the connecting bar 304 against a scope base 18 or 20. However, alignment device 300 can be mounted to a rifle 12 using other attachment mechanisms, depending on the implementation. As an example, as shown in FIGS. 8-10, an alignment device 300 can include an adapter 802. Adapter 802 allows alignment device 300 to be mounted to a rifle 12 by coupling to a corresponding slot 806 of a mounting platform 804. As shown in FIG. 10, after device 300 is positioned on mounting platform 804 of rifle 12, it is releasably secured using a rubber band 318, for example as described above.

Figure 11:
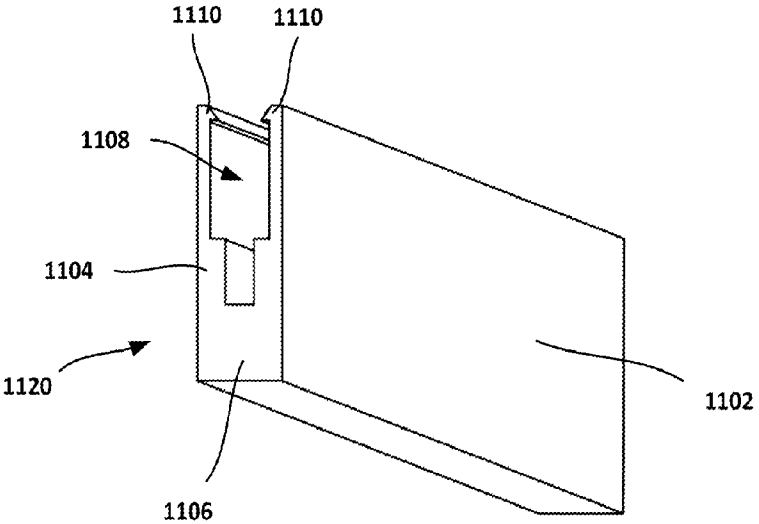
FIG. 11 is a perspective view of one embodiment of an adapter.
Figure 12:
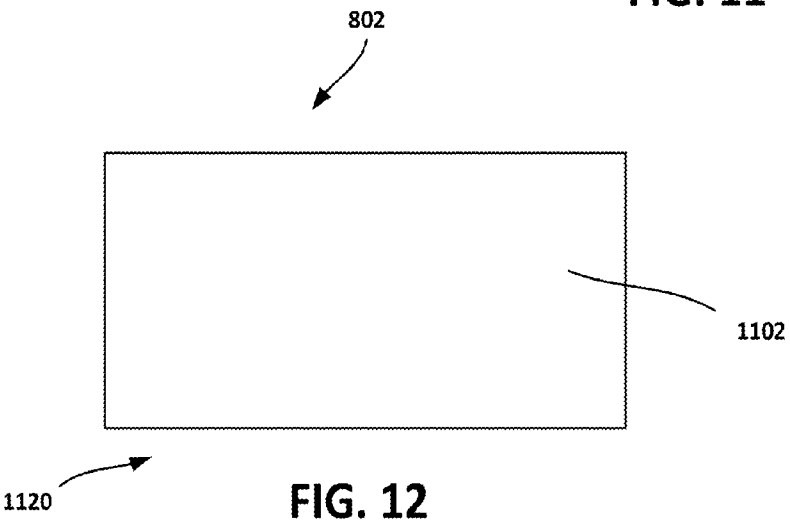
FIG. 12 is a front view of one embodiment of an adapter.
Figure 13:
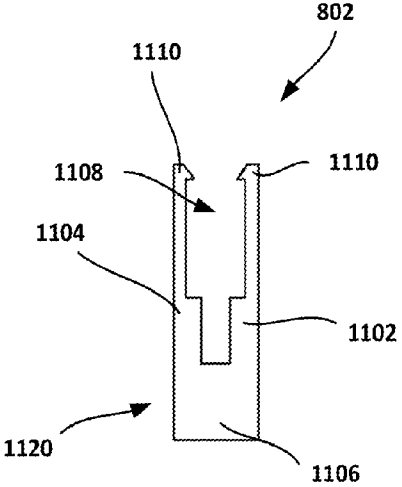
FIG. 13 is a side view of one embodiment of an example adapter.

As shown in FIG. 8, adapter 802 is positioned on connecting bar 304 between reference cards 302*a* and 302*b*. As shown in FIGS. 11-13, showing a perspective view, a front view, and a side view of adapter 802, respectively, adapter 802 has a front wall 1102, a rear wall 1104, a bottom wall 1106. The outer surfaces of walls 1102, 1104, and 1106 define a mounting prong 1120, and the inner surfaces of walls 1102, 1104, and 1106 define a channel 1108. Each of these walls 1102, 1104, and 1106 has a flat outer surface, and the walls are dimensioned such that mounting prong 1120 conforms to the dimensions of slots 806 of mounting platform 804. This allows the adapter 802 to slide securely into a slot 806 (for example as shown in FIGS. 8 and 9), and allows the adapter 802 to be slidably removed from the slot 806 after use. Channel 1108 is dimensioned such that adapter 802 can be secured to connecting bar 304. In the examples shown in FIGS. 11-13, channel 1108 has a square or rectangular cross-section with dimensions similar to that of the connecting bar 304, and allows the connection bar 304 to slidably insert through the channel 1108. While a square or rectangular cross-section is shown above, in some implementations, channel 1108 can have other cross-sections, depending on the cross-section of connecting bar 304. In some implementations, front wall 1102 and rear wall 1104 can additionally include protrusions 1110 to further secure adapter 802 to connecting bar 304. Protrusions 1110, for example, can provide additional friction between adapter 802 and connecting bar 304 to improve the stability between the two components, and prevent connecting bar 304 from slipping out of the top of channel 1108.

In some implementations, mounting platform 804 is a standardized mounting platform, and has slots with standardized dimensions. The walls 1102, 1104, and 1106 of adapter 802 can define a mounting prong 1120 with dimensions that conform to these standardized slot dimensions. As an example, in some implementations, mounting platform 804 is a Picatinny rail (also commonly known as a MIL-STD-1913 rail, STANAG 2324 rail, or tactical rail) having a series of standardized slots. Each slot has a standardized width of 0.206 inches and depth of 0.118 inches, and the centers of adjacent slots are separated by a distance of 0.394 inches. In this example, mounting prong 1120 of adapter 802 is dimensioned so that when adapter 802 is inserted into a slot, mounting prong 1120 of adapter 802 sits in flush contact against the surface of the slot and the adapter 802 does not substantially shift after insertion. To ensure that alignment device 300 is aligned correctly relative to the mounting platform 804 and the rifle 12, the outer surface of bottom wall 1106 is flat, such that mounting prong 1120 rests in flush contact with the bottom of slot 806, and adapter 802 rests level relative to the mounting platform 804.

Although a Picatinny rail is provided as an example of a mounting platform 804, mounting platform 804 can have other arrangements, depending on the implementation. For example, in some implementations, mounting platform 804 is a standardized Weaver rail having standardized slot dimensions different than that of a Picatinny rail. In order to securely mount alignment device 300 to a Weaver rail, adapter 802 can be instead dimensioned to correspond to the standardized slots dimensions of a Weaver rail. In some implementations, mounting platform 804 can include slots with non-standardized slot dimensions, and adapter 802 can be dimensioned to correspond to these non-standardized dimensions.

Figure 15:
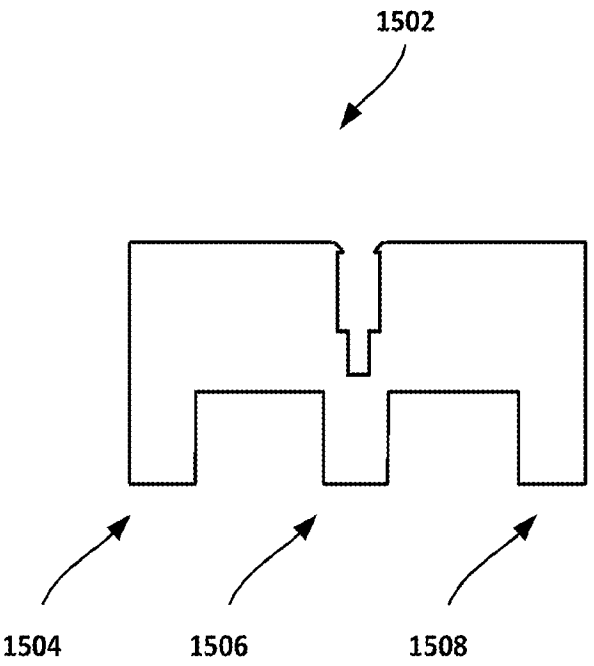
FIG. 15 illustrates an adapter having three mounting prongs.
Figure 14:
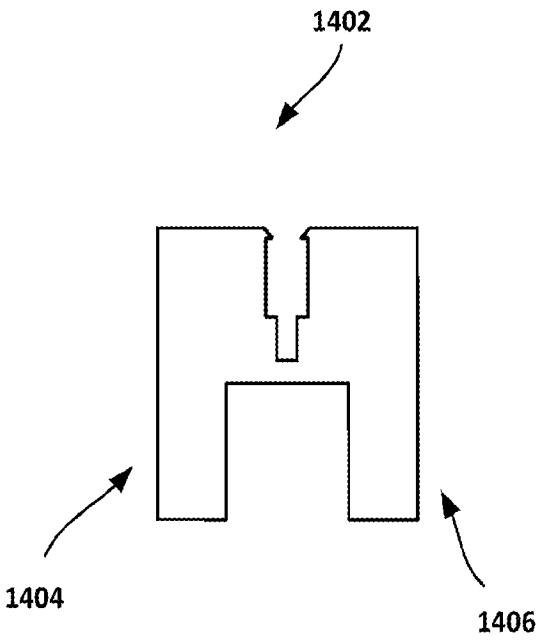
FIG. 14 illustrates an adapter having two mounting prongs.
Figure 16:
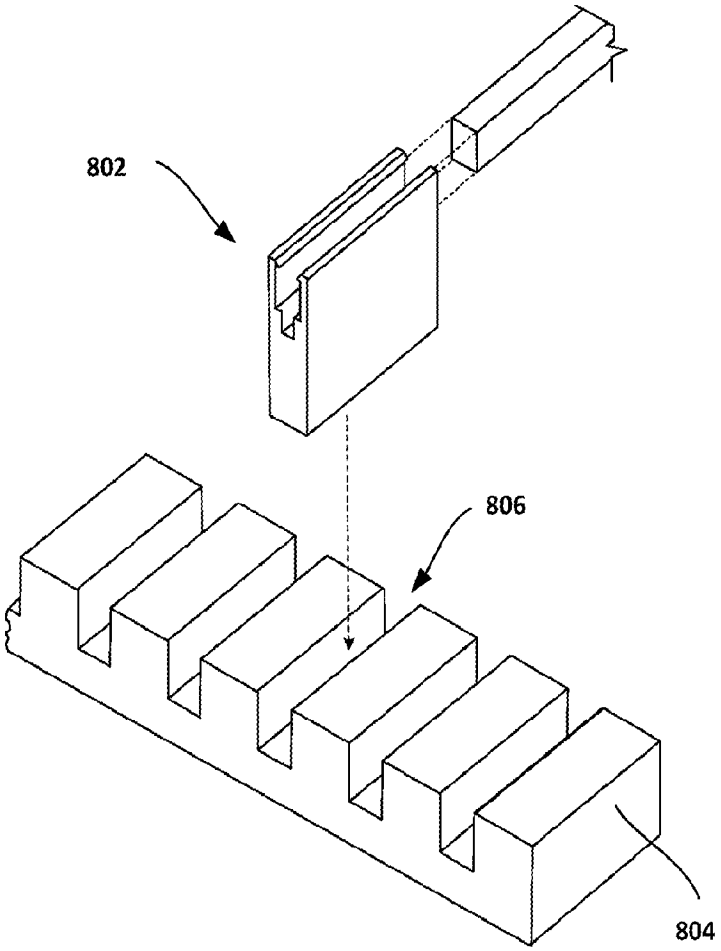
FIG. 16 illustrates insertion of a single prong adapter into a slotted mounting platform.
Figure 17:
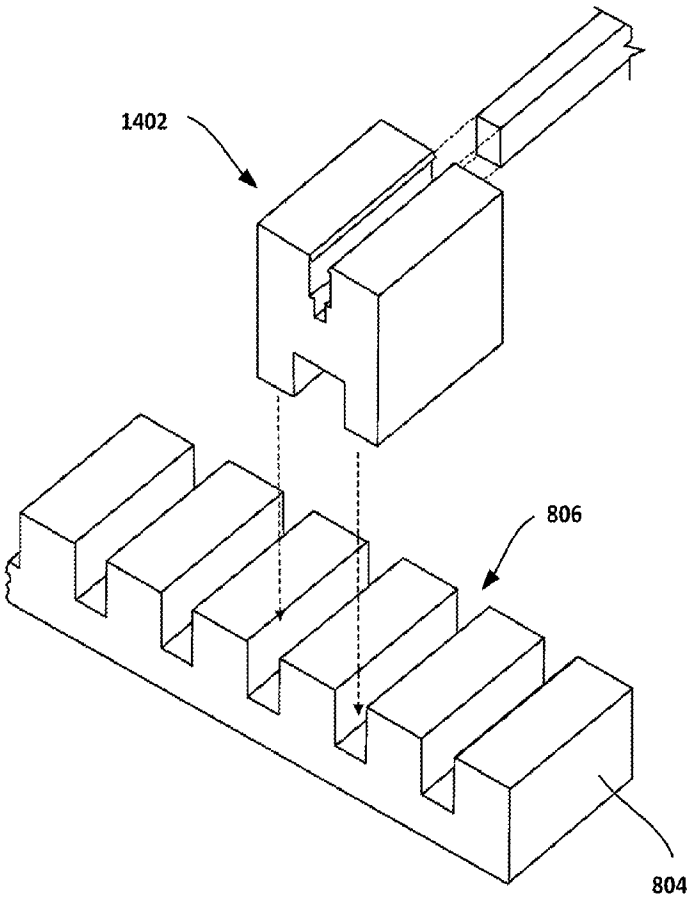
FIG. 17 illustrates insertion of a two-prong adapter into a slotted mounting platform.
Figure 18:
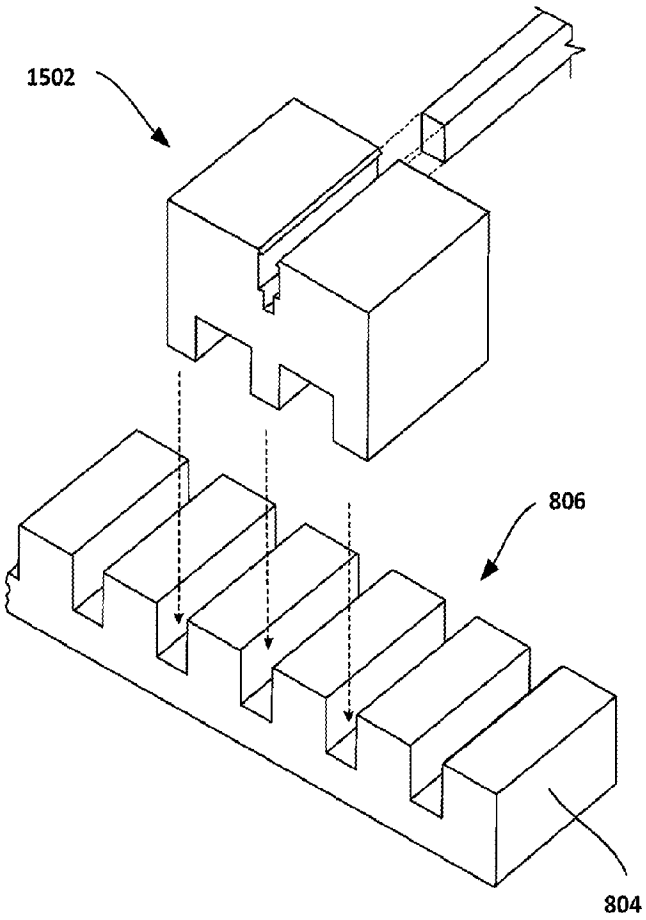
FIG. 18 illustrates insertion of a three-prong adapter into a slotted mounting platform.

While an example adapter 802 is shown and described above, adapters can have different arrangements and dimensions, depending on the implementation. For instance, in some implementations, an adapter can have more than one mounting prong. As examples, FIG. 14 shows an adapter 1402 having two mounting prongs 1404 and 1406, and FIG. 15 shows an adapter 1502 having three mounting prongs 1502, 1504, and 1506. An adapter having more than one mounting prong allows the adapter to couple with more than one slot of a mounting platform, and can, for example, improve the stability of the alignment device 300 within the mounting platform 802. For example, as shown in FIG. 16, a single pronged adapter 802 can fit into a single slot 806 of a mounting platform 804. As shown in FIG. 17, if instead a two-pronged adapter 1402 is used, the two-pronged adapter 1402 can fit into two adjacent slots 806 of mounting platform 804. This can, for example, provide stability by further restraining adapter 1402 (and thus, alignment device 300) from rocking in a direction parallel to the length of extension of mounting platform 804. As another example, as shown in FIG. 18, three-pronged adapter 1502 can fit into three adjacent slots 806 of mounting platform 804, and can provide additional stability to alignment device 300. While one, two, and three-pronged adapters are shown in these adapters, an adapter can have more prongs, for example four, five, six, or more, depending on the implementation.

In the above examples, multi-pronged adapters are arranged to couple with multiple adjacent slots of the mounting platform. However, in some implementations, the mounting prongs can couple with non-adjacent slots. Further, while the example adapters are shown has having a centrally positioned channel, in some implementations, the channel of an adapter can be arranged in a non-central position.

Figure 19:
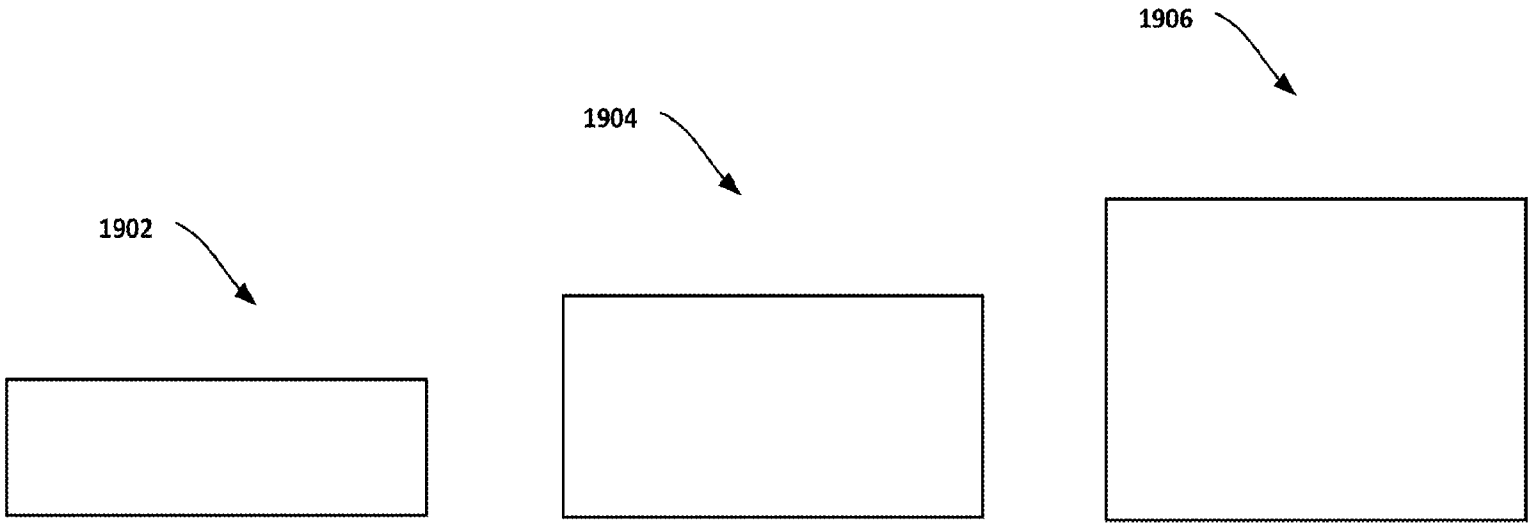
FIG. 19 is a front view of different adapters having different vertical heights.

In some implementations, different adapters can have different vertical heights, such that when the adapters are coupled to a slot of a mounting platform, each different adapter supports alignment device 300 at a different vertical height relative to the rifle 12. For example, FIG. 19 shows a front view of three example adapters 1902, 1904, and 1906, each having a different vertical height. Adapters having different heights can be advantageous in certain circumstances, as the dimensions of each firearm and telescopic sight can vary, as can the relative distance between each when they are co-mounted. In some instances, the user may prefer to mount his telescopic sight higher or lower above the barrel of the gun and thus will select a mounting adapter 1902, 1904, or 1906 that will provide the preferred distance above the barrel. Having adapters with different heights allows a user to use an adapter that supports alignment device 300 at a vertical height that is best suited for his particular application.

While several example adapter modifications are shown above, these examples are provided to illustrate how an adapter's arrangement can be varied in order to suit particular applications. In some implementations, an adapter can modified to incorporate combinations of one or more of the above features. As an example, an adapter can have two mounting prongs, a centrally-located channel, and a relatively low vertical height. As another example, an adapter can have three mounting prongs, a non-centrally-located channel, and a relatively high vertical height. In this manner, the arrangement of an adapter can vary to suit each particular application, and is not limited by the example arrangements and combinations shown above.

Figure 20:
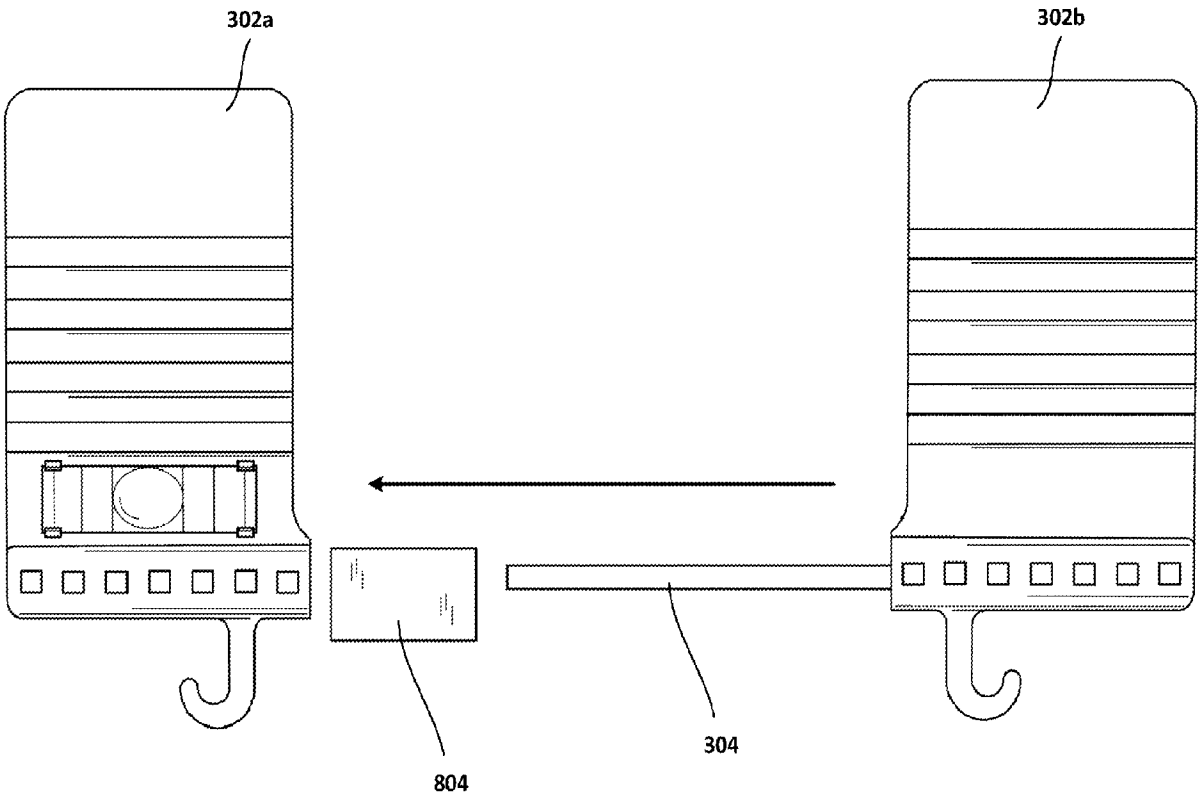
FIG. 20 illustrates one embodiment of the attachment relationship between an adapter and the other components of an alignment device.

In some implementations, a user can add, remove, or interchange adapters 804 from alignment device 300 depending on the desired application. As shown in FIG. 20, as an example, reference cards 302*a* and 302*b* can be provided as separate components, with the connecting bar 304 affixed to one of the cards (in this example, card 302*b*). A user can select an adapter appropriate for his desired application (e.g., an single-pronged adapter 802 corresponding to the mounting platform of his firearm), and secure the selected adapter by inserting the free end of connecting bar 304 through the adapter's channel (e.g., channel 1108). The user then secures reference card 302*a* and 302*b* together by inserting the free end of connecting bar 304 into reference card 302*a*. The adapter can be removed and/or replaced by pulling apart the reference cards 302*a* and 302*b*, removing the adapter from the connecting bar 304, and attaching another adapter (e.g., an adapter 1402), if desired. In this manner, a user can switch between several different adapters, or opt not to use an adapter at all, depending on his desired application. This also allows a user to use a single set of reference cards 302*a* and 302*b*, minimizing the expense of acquiring and maintaining multiple sets of reference cards.

Further, the user can adjust the distance between reference cards 302*a* and 302*b* in order to better suit the desired application. For example, the user can push the reference cards together, or pull the reference cards apart, while maintaining the connection between each of the cards 302*a* and 302*b* and the connecting bar 304. This allows a user to use alignment device 300 with firearms and telescopic sights of varying dimensions.

A number of implementations have been described. Nevertheless, it will be understood that various modifications may be made without departing from the spirit and scope of the invention. Accordingly, other embodiments are within the scope of the following claims.

What is claimed is:

1. A device for aligning the cross-hairs of a reticle of a telescopic sight mounted on a mounting surface of a firearm, the device comprising:

a first card having at least one reference line arrayed across a front surface of the first card and at least one reference line arrayed across a rear surface of the first card;

a second card having at least one reference line arrayed across a front surface of the second card and at least one reference line arrayed across a rear surface of the second card;

a connecting element holding the first card and the second card together in a common plane, the connecting element having at least one flat surface parallel to the reference lines of the reference cards;

and a level mounted to the first card and oriented in a direction parallel to the flat surface;

wherein when the device is positioned flush against the mounting surface of the firearm, the level indicates the levelness of the mounting surface, and the reference lines indicate the position of a properly aligned reticle.

2. The device of claim 1, further comprising a first hook on the first card and a second hook on the second card, wherein when the device is positioned flush against the mounting surface of the firearm, the device may be secured to the firearm by a fastener connecting the first hook to the second hook.

3. The device of claim 1, wherein the thickness of the at least one line arrayed across the front surfaces of the cards is different than the thickness of the one or more lines arrayed across the rear surfaces of the cards.

4. The device of claim 1, wherein more than one line is arrayed across the front surface of the cards and the more than one lines are parallel to one another.

5. The device of claim 4, wherein the number of parallel lines of the front surfaces of the cards is different than the number of parallel lines of the rear surfaces of the cards.

6. The device of claim 1, furthering comprising a grid on the front surfaces of the first and second cards.

7. The device of claim 1, further comprising a second level oriented in a different direction than the direction of the first level.

8. The device of claim 1 wherein the level is visible from both sides of the first card.

9. The device of claim 8 wherein the level comprises a spirit level.

10. The device of claim 8 wherein the fastener is a rubber band.

11. The device of claim 1 wherein the level is releasably secured to the first card.

12. The device of claim 1 wherein the first card has a front surface and a rear surface and the level is mounted to be visible from the front surface or rear surface of the first card.

13. The device of claim 1 wherein the firearm has a bore axis and the telescopic sight has a bore axis and the distance between the bore axis of the firearm and the bore axis of the telescopic sight is between about 1.5 and 2 inches.

14. The device of claim 1 wherein the level is adjustably secured to the first card.

15. A method of aligning the cross hairs of a reticle of a telescopic sight mounted on a firearm which comprises:

attaching to the telescopic sight a device comprising:

a first card having at least one reference line arrayed across a front surface and at least one reference line arrayed across a rear surface;

a second card having at least one reference line arrayed across a front surface and at least one reference line arrayed across a rear surface;

a connecting element holding the first card and the second card together in a common plane, the connecting element having at least one flat surface parallel to the reference lines of the reference cards; and a level mounted to the first card and oriented in a direction parallel to the flat surface;

positioning the device against the mounting surface of the firearm such that the connecting element is flat on a mounting surface on the gun and the level indicator indicates the gun is in a level position; and adjusting the horizontal cross hair of the reticle to be parallel to the at least one reference line on the first and second cards.

* * * * *